US007654270B2

(12) United States Patent
Gueret

(10) Patent No.: US 7,654,270 B2
(45) Date of Patent: Feb. 2, 2010

(54) BRUSH FOR APPLYING SUBSTANCE TO EYELASHES AND/OR EYEBROWS

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 608 days.

(21) Appl. No.: 10/768,012

(22) Filed: Feb. 2, 2004

(65) Prior Publication Data

US 2004/0168698 A1 Sep. 2, 2004
US 2009/0139535 A2 Jun. 4, 2009

Related U.S. Application Data

(60) Provisional application No. 60/449,751, filed on Feb. 26, 2003.

(30) Foreign Application Priority Data

Feb. 4, 2003 (FR) ..... 03 01269

(51) Int. Cl.
*A45D 40/26* (2006.01)
*A45D 34/00* (2006.01)
*A46B 9/02* (2006.01)
*A46B 11/00* (2006.01)

(52) U.S. Cl. ..... 132/200; 132/218; 401/122; 401/129; 15/206; 15/207.2; 15/DIG. 5; 15/DIG. 6

(58) Field of Classification Search ..... 15/206, 15/207, 207.2, 167.3, DIG. 5, DIG. 6; 132/218, 132/200, 313; 401/122, 129
See application file for complete search history.

(56) References Cited

U.S. PATENT DOCUMENTS

| | | | | | |
|---|---|---|---|---|---|
| 2,895,155 | A * | 7/1959 | Peterson | 15/192 |
| 4,504,998 | A * | 3/1985 | Price et al. | 15/186 |
| 4,561,456 | A * | 12/1985 | Gueret | 132/218 |
| 4,882,879 | A * | 11/1989 | Warner et al. | 451/469 |
| 5,161,554 | A | 11/1992 | Fitjer | |
| 5,161,555 | A | 11/1992 | Cansler et al. | |
| 5,321,919 | A * | 6/1994 | Scheider et al. | 451/463 |
| 5,873,140 | A * | 2/1999 | Holloway | 15/167.2 |
| 6,012,465 | A * | 1/2000 | Gueret | 132/218 |
| 6,079,087 | A | 6/2000 | Cansler | |
| 6,219,875 | B1 * | 4/2001 | Medynski et al. | 15/167.1 |
| 6,224,287 | B1 * | 5/2001 | Gieux | 401/282 |
| 6,227,735 | B1 | 5/2001 | Gueret | |
| 7,052,199 | B2 * | 5/2006 | Rousselet | 401/129 |
| 2002/0124860 | A1 | 9/2002 | Gueret | |

(Continued)

FOREIGN PATENT DOCUMENTS

EP 1 155 637 A1 11/2001

(Continued)

OTHER PUBLICATIONS

Machine translation of French patent 2744607, Sep. 27, 2008.*

*Primary Examiner*—Gary K Graham
(74) *Attorney, Agent, or Firm*—Oliff & Berridge, PLC

(57) ABSTRACT

A brush for applying a substance onto keratinous fibers includes a core and bristles that are supported by the core and made other than by being injection molded together with the core. In embodiments, the brush has at least a portion that carries bristles that are curved and extend from the core in oriented manner.

22 Claims, 5 Drawing Sheets

U.S. PATENT DOCUMENTS

| | | | | |
|---|---|---|---|---|
| 2003/0172485 | A1 * | 9/2003 | Dumler et al. | 15/206 |
| 2004/0129286 | A1 * | 7/2004 | Chan | 132/218 |

FOREIGN PATENT DOCUMENTS

| | | | |
|---|---|---|---|
| FR | 2 744 607 | | 8/1997 |
| FR | 2744607 | * | 8/1997 |
| FR | 2 753 354 | | 3/1998 |
| JP | A-4-158805 | | 6/1992 |
| JP | A 2000-505669 | | 5/2000 |
| JP | A 2001-154454 | | 6/2001 |
| JP | A 2002-325629 | | 11/2002 |
| JP | A 2002-355122 | | 12/2002 |

* cited by examiner

FIG_6
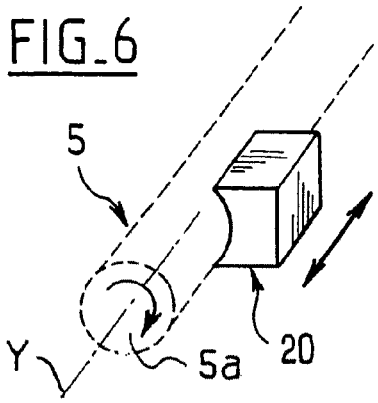
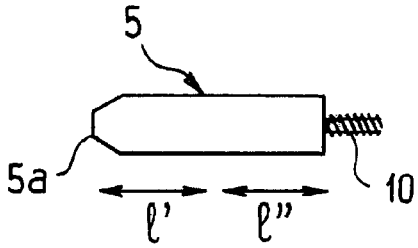
FIG_7
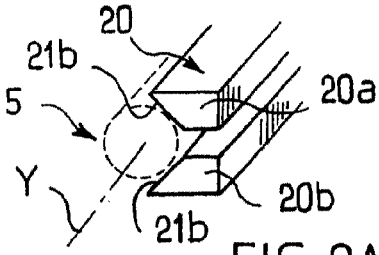
FIG_9A
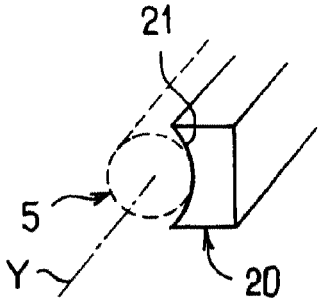
FIG_8
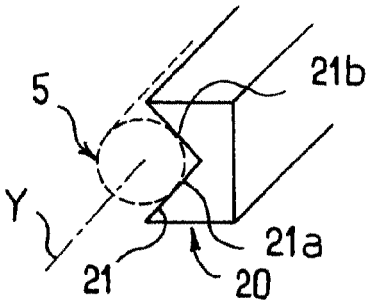
FIG_9
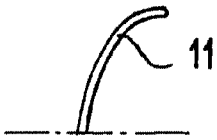
FIG_10
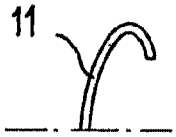
FIG_11
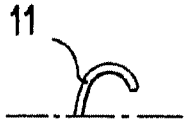
FIG_12
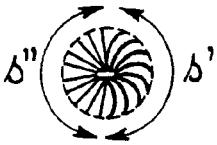
FIG_13
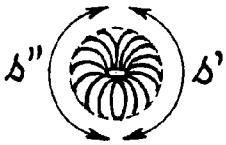
FIG_13A
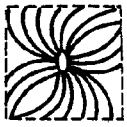
FIG_13B
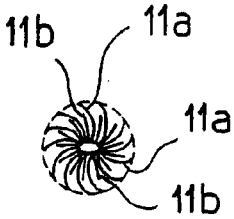
FIG_14

BRUSH FOR APPLYING SUBSTANCE TO EYELASHES AND/OR EYEBROWS

This application claims the benefit of French Application No. 03 01269 filed on Feb. 4, 2003 and U.S. Provisional Application No. 60/449,751 filed on Feb. 26, 2003, the entire disclosures of which is incorporated by reference herein.

FIELD OF INVENTION

The present invention relates to applicators for applying a substance to keratinous fibers, such as, for example, eyelashes and/or eyebrows. More particularly, but not exclusively, the present invention relates to mascara brushes.

BACKGROUND

U.S. Pat. No. 4,561,456 describes a brush made by injection molding a plastics material and has bristles with ends that are hook-shaped. A drawback of such a brush is that its manufacture requires a special mold. In addition, the way the bristles are implanted is substantially different from a conventional brush with a twisted core.

SUMMARY OF THE INVENTION

Exemplary embodiments of the present invention provide an improved brush which is relatively easy to manufacture, while also being capable of applying makeup in satisfactory manner.

In various exemplary embodiments, the invention provides a brush for applying a substance onto keratinous fibers, the brush comprising: a core; and bristles supported by the core and made other than by being injection molded together with the core; the brush including at least one portion having bristles that are curved so as to extend from the core in an oriented manner.

The phrase "extend in oriented manner" is used to mean that the curved bristles extend with a general orientation that is defined during manufacture of the brush. For example, the general orientation may be defined after insertion of the bristles in the core, and not with a general orientation that is completely random or only resulting from a weight of the bristles.

In exemplary embodiments, the bristles may or may not extend entirely substantially in a single plane. Further, in exemplary embodiments, the curvature of the bristles may be defined in at least two planes non-parallel to each other.

In exemplary embodiments, the brush may be of any type having bristles fitted to a core thereof.

Exemplary embodiments of the present invention provide a brush having advantages associated with the curvature of the bristles, while also being suitable for manufacture with a conventional twisted core. For example, exemplary embodiments of the present invention make it possible to provide brushes having a variety of implantations, for example, for obtaining various makeup effects, without requiring special and expensive molds for manufacture. In addition, exemplary embodiments of the present invention provide a brush that is suitable for retaining a relatively large quantity of substance, for example, making it possible to coat eyelashes thoroughly.

In exemplary embodiments, the brush may include at least a portion with curved bristles oriented in a same circumferential direction about the core.

In exemplary embodiments in which the core is twisted, the core may be twisted to the left, i.e., the branches of the core may form spirals which rise going from left to right, as the brush is observed in a vertical position with an end thereof that is fixed in a stem, i.e., a proximal end of the brush, situated at the bottom and a free end thereof, i.e., a distal end of the brush, situated at the top. In exemplary embodiments of a left-twisted brush, the bristles may be oriented in a clockwise direction, as the brush is observed along an axis from the distal end toward the proximal end. In other exemplary embodiments of a left-twisted brush, the bristles may be oriented in a counterclockwise direction. Certain advantages that result from having a core which is twisted to the left are described in U.S. Pat. No. 6,227,735, the entire disclosure of which is incorporated by reference herein. Imparting curvature, in the manner described above, to the bristles of a brush with a core that is twisted to the left makes it possible to further improve the way eyelashes are taken in charge and/or to further improve the application of makeup.

Exemplary embodiments of the present invention provide brushes with a core that is twisted to the right. Further, exemplary embodiments of the present invention provide brushes with a core that is not twisted. In such embodiments, the bristles may be fixed by being punched into the core, for example, as described in European Patent Application No. EP-A-1,155,637. Alternatively or additionally, the bristles may be fixed by being stapled to the core.

In exemplary embodiments, the brush may include at least a portion carrying curved bristles that are generally oriented in a same axial direction, for example, toward the proximal end of the brush or toward the distal end of the brush. Where appropriate, exemplary embodiments of the brush may have bristles oriented "obliquely" both in a given circumferential direction and in a given axial direction.

In exemplary embodiments, the portion of the brush that includes curved bristles extending from the core in an oriented manner may, at a maximum, correspond to the entire brush. However, the portion need not correspond to the entire brush, for example, and may correspond merely to a portion extending from one end of the brush and over less than half the length thereof, for example. Further, the portion may correspond to special regions of the brush, for example, regions that define peaks and/or notches.

In exemplary embodiments, at least 20% of the bristles of a brush may be curved. In exemplary embodiments, at least 50% of the bristles of a brush may be curved. In exemplary embodiments at least 80% of the bristles of a brush may be curved. In exemplary embodiments, substantially all of the bristles of the brush are curved.

In exemplary embodiments, the brush may include five to 60 bristles per turn, for example. The number of bristles per turn corresponds to the number of bristle ends counted by a stationary observer while the brush is being turned through 180° about the core of the brush.

In exemplary embodiments, the bristles may be made of synthetic material. For example, the bristles may be made of a thermoplastic material.

In exemplary embodiments, the bristles may have a section that is solid or hollow and that is optionally circular. In exemplary embodiments, the cross-section of the bristles may be constant or otherwise along a length thereof. For example, the cross-section of the bristles may have alternating sections of large diameter and sections of small diameter. Further, in exemplary embodiments, the bristles may carry a coating of flocking.

In exemplary embodiments, the bristles may include a filler. For example, the bristles may include a filler of a magnetic compound, a moisture-absorbing compound, a compound for imparting roughness to the surface of the bristle, and/or a compound for improving sliding of the bristles, for example, over eyelashes.

In exemplary embodiments, a diameter of the bristles may lie in a range of about 5/100 millimeters (mm) to about 35/100 mm. The term bristle "diameter" is used to designate the diameter of a circle circumscribing a largest cross-section of the bristle, if the bristle is not entirely cylindrical.

In exemplary embodiments, a length of the bristles may lie in a range of about 1 mm to about 7 mm, for example. In exemplary embodiments, a length of the bristles may lie in a range of about 2 mm to about 5 mm.

In exemplary embodiments, the brush may comprise a mixture of bristles of different lengths and/or different kinds.

For example, in exemplary embodiments, only the longest bristles of the brush may be curved in shape, with the others extending in a rectilinear manner from the core.

In exemplary embodiments in which the brush includes a mixture of bristles of different kinds, only bristles of a certain kind need be curved, for example. In exemplary embodiments, the brush may include, for example, bristles made of materials having different vitreous transition temperatures. In such embodiments, only those bristles that are made of the material having the lowest vitreous transition temperature may be curved.

In exemplary embodiments, an envelope surface of the brush may have a variety of shapes. For example, the brush may have various cross-sections that are circular, oval, polygonal, and/or other shapes, and may have one or more indentations and/or notches.

In exemplary embodiments, the core may be centered in a cross-section of the envelope surface.

In exemplary embodiments, the cross-section of the envelope surface may be constant over at least a portion of the length of the brush, or otherwise. In exemplary embodiments, the brush may, for example, have a cross-section passing through an extremum between the two axial ends of the brush. The extremum may be a maximum or a minimum, for example. The brush may thus have, as seen from the side, a shape that is generally hourglass-shaped or football-shaped, for example.

In exemplary embodiments, the core may be rectilinear. In exemplary embodiments, the core may be curved, for example, with a curvature distributed over the length of the core or localized only in a region close to a region of the core that is used for fixing the brush to an applicator stem.

Where appropriate, the brush may be curved about at least two axes that are not coplanar.

Exemplary embodiments of the present invention provide a packaging and applicator device including such a brush.

Exemplary embodiments of the present invention provide a method of manufacturing a brush for applying a substance onto keratinous fibers, such as, for example eyelashes and/or eyebrows, the method comprising: curving bristles of the brush by bringing the bristles into contact with a hot surface. In exemplary embodiments, the bristles of the brush may be brought into contact with a surface that is moving relative to the brush.

In exemplary embodiments, the surface may be defined by a material having a relatively low thermal conductivity, such as, for example: a silicone, a fluorine-containing polymer, such as polytetrafluoroethylene (PTFE), or an inorganic material other than a metal, for example, graphite. The use of a material having a relatively low thermal conductivity makes it possible to prevent the bristles sticking to the hot surface while the brush is being treated. Further, the use of a material having a relatively low thermal conductivity makes it possible to avoid melting the ends of the bristles and/or even welding the ends together.

In exemplary embodiments, the relative movement between the brush and the hot surface may be selected as a function of the general orientation that is desired to be imparted to the bristles.

In exemplary embodiments of the invention, the brush may be rotated about the axis thereof, thereby enabling at least one longitudinal portion of the brush to be treated over an entire circumference thereof.

In exemplary embodiments, the hot surface may be defined by a stationary treatment member. In other exemplary embodiments, the hot surface may be defined by a treatment member that is moved axially during the treatment, for example, in only a single direction or with a reciprocating motion.

In exemplary embodiments, movement of the treatment member in a single axial direction may serve to orient the bristles toward the proximal end of the brush or toward the distal end of the brush, for example.

In exemplary embodiments, rotating the brush may serve, for example, to orient the bristles in a common circumferential direction. In exemplary embodiments, the common circumferential direction may be selected as a function of the orientation of the turns of the core, for example, in embodiments in which the brush is a twisted-core brush.

In exemplary embodiments of the invention, the treatment member may be caused to rotate, for example, with the brush being stationary. In exemplary embodiments, the treatment member may be likewise caused to rotate, for example, in a same direction of rotation or in a direction of rotation opposite to that of the treatment member. In exemplary embodiments, brush may be displaced axially relative to the treatment member.

In exemplary embodiments, the hot surface may have a variety of shapes depending on the treatment that is to be performed.

In exemplary embodiments, the hot surface may have a shape that causes the brush to bear over a single sector of the circumference of the hot surface. In exemplary embodiments, the hot surface may have a shape that causes the brush to bear against two separate sectors of the circumference of the hot surface, for example, in embodiments in which the hot surface is in the form of two planes intersecting at a dihedral angle that is small enough for the bristles of the brush not to reach the intersection.

In exemplary embodiments, a state of the surface of the treatment member may be selected as a function of the treatment that is desired to be perform. Thus, in exemplary embodiments, the hot surface may be smooth or may be slightly rough, for example.

Exemplary embodiments of the present invention provide a machine for manufacturing a brush for applying a substance onto keratinous fibers. In exemplary embodiments, such a machine may be suitable for implementing the above-defined method. In exemplary embodiments, the machine comprises: a support arranged to support at least one brush; and a treatment member for treating at least the brush and comprising: a surface arranged to come into contact with the bristles of the brush; heater means for heating the surface; and means for imparting relative displacement between the support and the treatment member so as to modify, in a predefined manner, the orientation of the bristles of the brush that come into contact with the surface of the treatment member.

For example, in exemplary embodiments, the means for imparting relative displacement may comprise at least one motor for rotating the brush about the axis thereof and/or for rotating the treatment member. Where appropriate, the motor may drive the brush and/or the treatment member with an axial displacement. In exemplary embodiments, the means for imparting relative displacement may also serve to move the brush and the hot surface of the treatment member toward each other and/or apart from each other. In exemplary embodiments, the brush and the treatment member may be driven simultaneously to rotate about axes that are parallel or that are not parallel.

In exemplary embodiments in which the brush includes a twisted core, for example, a core twisted to the left, the brush may be rotated about the axis thereof in a counterclockwise direction as the brush is observed end-on from the distal end. This causes the bristles to be oriented in the circumferential direction, for example, which is favorable to the bristles of the brush taking proper charge of eyelashes.

In exemplary embodiments, the temperature to which the surface of the treatment member is heated may depend on the nature of the bristles of the brush and/or on the treatment that is to be imparted to the bristles. For example, in exemplary embodiments, the temperature may lie in a range of about 80° C. to about 220° C. In exemplary embodiments, the temperature may be not less than about 150° C., for example, in embodiments in which the bristles of the brush are made of polyamide 6/6, 6/10, 6/12, or 11.

In exemplary embodiments in which the brush is rotated, the speed at which the brush is rotated may lie in a range of about 100 revolutions per minute (rpm) to about 1200 rpm. In exemplary embodiments, this speed may be selected as a function specifically of the temperature of the treatment member, the contact pressure between the bristles and the treatment member, and/or the shape of the treatment member.

BRIEF DESCRIPTION OF THE DRAWINGS

The invention can be better understood on reading the following detailed description of non-limiting embodiments thereof, and on examining the accompanying drawings, in which:

FIG. 6 is a diagrammatic perspective view showing another exemplary embodiment of a treatment member according to the invention;

FIG. 7 is a diagrammatic partial plan view showing treatment of only a portion of the length of the brush according to the invention;

FIGS. 8, 9, and 9A are diagrammatic partial perspective view showing other exemplary embodiments of a treatment member according to the invention;

FIGS. 10 to 12 are diagrammatic views showing various exemplary shapes of a bristle that can be obtained according to the invention;

FIG. 13 is a diagrammatic cross-section views of a brush showing treatment of only an angular sector of the brush according to the invention;

FIGS. 13A and 13B are diagrammatic cross-section views of a brush showing different treatment of at least two angular sectors of the brush according to exemplary embodiments of the invention;

FIG. 14 is a diagrammatic cross-section view of an exemplary embodiment of a brush having short bristles that are rectilinear and long bristles that are curved;

DETAILED DESCRIPTION OF EXEMPLARY EMBODIMENTS

Figure 1:
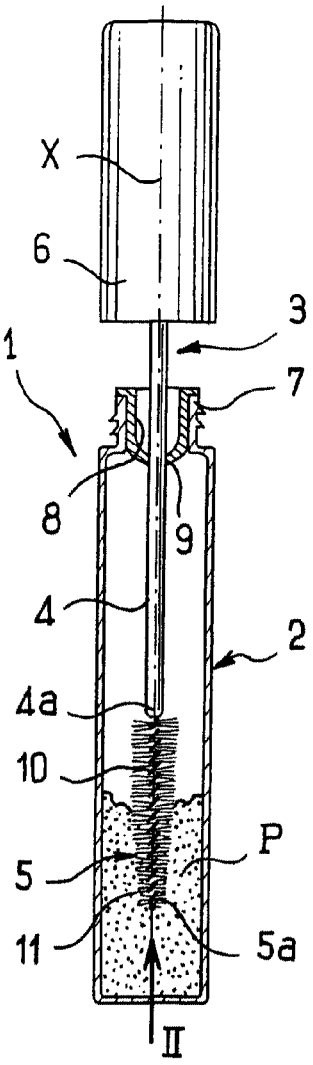
FIG. 1 is a diagrammatic axial section view of a packaging and applicator device including a brush according to an exemplary embodiment of the invention.

FIG. 1 shows a packaging and applicator device 1 comprising a receptacle 2 containing a substance P, for example, mascara, for applying to eyelashes and/or eyebrows and an applicator 3 comprising a stem 4 having a longitudinal axis X and provided at one end 4*a* with a brush 5 and at an opposite end with a handle member 6 that may also serve to close the receptacle 2. The receptacle may have a neck 7 with an outside thread so as to enable the handle member 6 to be screwed thereon.

A wiper member 8 may be fixed inside the neck 7 for wiping the stem 4 and/or the brush 5 while being taken out of the receptacle 2. The wiper member 8 may have a flexible lip 9 that defines a circular orifice with a diameter substantially corresponding to a diameter of the stem 4.

It should be understood that the invention is not limited to using a particular wiper member. Wiper members other than that shown in the exemplary embodiment of FIG. 1 may also be used. For example, wiper members comprising a block of foam and/or defining one or more slots, which may optionally be flocked, may also be used.

In the exemplary embodiment shown, the stem 4 is rectilinear. However, the stem 4 may be curved according to the present invention.

Also, in the exemplary embodiment shown, the stem 4 is fixed relative to the handle member 3. However, the stem 4 may be movable relative to the handle member 3, for example, by an articulated connection, such as, for example, one including a ball-and-socket joint.

The brush 5 may include a core 10 comprising two twisted-together metal strands. The core 10 may be fixed at one end in a socket in the stem 4. For example, The core 10 may be force-fit in the socket.

Figure 2:
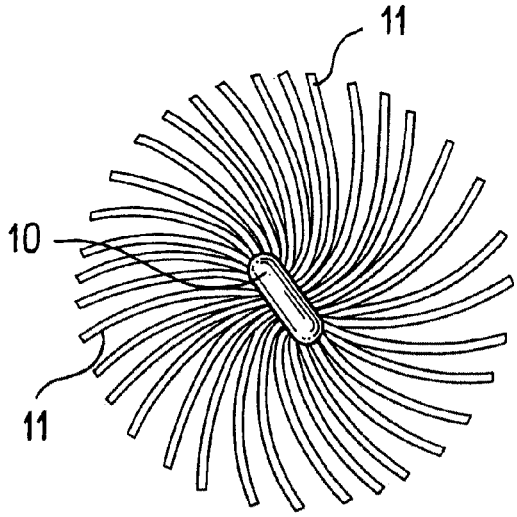
FIG. 2 is a diagrammatic view of the distal end of the brush of FIG. 1 taken along arrow II.
Figure 3:
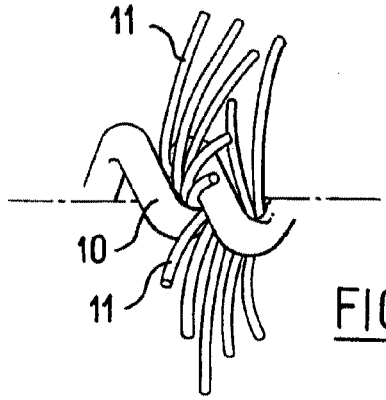
FIG. 3 is a diagrammatic and fragmentary view showing bristles held between twisted branches of the core of the brush of FIG. 1.

The brush 5 may also have bristles 3 that are held in place, for example, by being clamped between the twisted-together strands of the core 10, as shown in FIGS. 2 and 3. In FIG. 3, the core is shown with a proximal end of the brush 5 on the left and a distal end of the brush 5 on the right. The brush 5 shown in FIG. 3 is said to be "twisted to the left".

In exemplary embodiments of the invention, the brush 5 includes at least one portion having bristles 11 that are not rectilinear. For example, the bristles 11 may be curved in shape, as shown in FIG. 2, for example. In the exemplary embodiment shown, the bristles 11 are generally curved in a same circumferential direction, i.e., counterclockwise in FIG. 2. The bristles 11 may be curved in such a manner as to ensure that the bristles 11 are not totally rectilinear from the point where the bristles 11 cease to be in contact with the core 10 all the way to a free end of the bristles 11.

In exemplary embodiments, the bristles 11 may be curved so as to extend from the core 10 in an oriented manner.

The curved bristles 11 may extend with a general orientation that is defined during manufacture of the brush, for example. In exemplary embodiments, the bristles 11 do not have a general orientation that is completely random or only resulting from a weight of the bristles 11.

In exemplary embodiments, the curvature of the bristles 11 may be defined in at least two distinct planes. For example, a bristle 11 may have at least a first curvature measured in a first plane and a second curvature measured in a second plane. The second plane may be perpendicular to the first plane, for example.

Further, a curved bristle 11 may include both a curvilinear portion and a rectilinear portion, the rectilinear portion extending, for example, over less than half, one-third, or one-fourth of the length of the portion of the bristle 11 extending from the core 10 to the free end of the bristle 11.

In embodiments in which the curved bristle 11 includes a rectilinear portion, the rectilinear portion may extend, for example, toward the core 10 from a point situated at a distance, as measured from the free end of the bristle 11, that is less than ¾, or ⅔, or ½ of a length of the portion of the bristle 11 extending from the core 10 to the free end of the bristle 11.

In embodiments in which the curved bristle 11 includes a rectilinear portion, a cross-section of the bristle 11 may be constant along the rectilinear portion.

Figure 4:
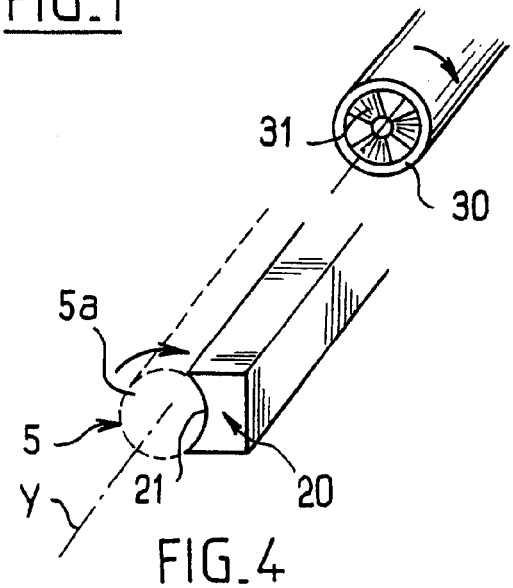
FIG. 4 is a diagrammatic partial perspective view showing an exemplary embodiment of a treatment to which the brush may be subjected according to the invention.
Figure 5:
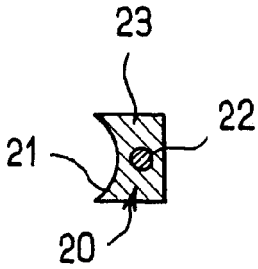
FIG. 5 is a diagrammatic cross-section view of the treatment member of FIG. 4.

In order to make the exemplary brush of FIGS. 1 to 3, the brush 5 may be brought into contact, as shown in FIG. 4, with a treatment member 20 comprising a surface 21 that may be touched by the bristles 11 of the brush 5.

In exemplary embodiments, the bristles 11 may be already held by the core 10 when the bristles 11 are treated.

For example, it is possible to start with a brush 5 having an envelope surface that is circularly cylindrical about an axis Y, that may coincide with the above-mentioned axis X. Then the brush 5 may be rotated about the axis Y while the brush 5 is in contact with the surface 21. The radius of curvature of the surface 21 may substantially correspond to the radius of the envelope surface of the brush 5 so that contact between the brush 5 and the treatment member 20 takes place over an angular sector of the brush 5.

Prior to treatment by the treatment member 20, the bristles 11 of the brush 5 may extend, for example, in a substantially rectilinear manner from the core 10 and may have a substantially constant cross-section. Thus, the initial bristles 11 may be bristles 11 without undulations, for example.

In the exemplary embodiment of FIG. 4, the treatment member 20 extends parallel to the axis Y over at least the entire length of the brush 5.

In order to obtain a bristle curvature as shown in FIG. 2, the brush 5 may be rotated, for example, about the axis Y in the clockwise direction when the brush is observed along the axis Y with the distal end 5*a* of the brush 5 in front, as shown in FIG. 4.

In exemplary embodiments, the treatment member 20 has heater means 22, for example, an electrical resistance element or a duct for circulating a heat-conveying fluid, thereby enabling the surface 21 to be raised to a temperature that is sufficient to lead to permanent deformation of the bristles 11 of the brush 5 after the bristles 11 have been brought into contact with the treatment member 20.

The surface 21 may be raised to a temperature of about 150° C., for example, for a brush 5 comprising bristles 11 made of polyamide, such as, for example, polyamide 6/6.

The brush 5 may be rotated at a speed of about 1000 rpm, for example, if the brush 5 has polyamide bristles 11, such as, for example, bristles 11 made of polyamide 6/6, with the surface 21 being at a temperature of about 150° C., by a support 30. The support 30 may be coupled to a motor and may include a jaw 31 for taking hold of the core 10 of the brush 5.

In exemplary embodiments, the treatment member 20 comprises a body 23 defining the surface 21. The body 23 may be made of a material that has relatively poor thermal conductivity, such as, for example, silicone, thus making it easier for the bristles 11 coming into contact with the surface 21 to avoid sticking thereto, and, for example, to help ensure that the ends of the bristles 11 do not melt and become welded together. Alternatively, only a surface coating on the treatment member 20 may be made out of such a material.

FIGS. 6 and 7 show exemplary embodiments in which the treatment member 20 does not extend over the full length of the brush 5, for example, in order to treat only a portion l' or l" thereof, the portions l' and l", respectively extending from the distal end and the proximal end of the brush 5, each over about half the total length of the brush 5.

The exemplary embodiment of FIG. 6 shows that it is possible to impart relative movement along the Y axis of the brush 5 between the brush 5 and the treatment member 20, for example, for the purpose of pointing the bristles 11 toward the proximal end or toward the distal end, as well as possibly orienting the bristles 11 in the circumferential direction.

The exemplary embodiment of FIG. 8 shows that it is possible for the treatment member 20 to have a surface 21 with a radius of curvature that is greater than the radius of curvature of the cylindrical envelope of the brush 5, for example. Depending on the radius of curvature of the surface 21, it should be understood that it is possible to affect the contact time between the bristles 11 of the brush 5 and the surface 21 for given speed of rotation of the brush 5 about the axis Y.

The surface 21 may have a variety of shapes. For example, the surface 21 need not have a shape that is circularly cylindrical, as shown in FIG. 9.

In FIG. 9, the surface 21 comprises two planar portions 21*a* and 21*b* that intersect at a dihedral angle, with the bristles 11 of the brush 5 being capable of coming into contact with the portions 21*a* and 21*b*, while bristles 11 of the brush that are situated between these portions 21*a* and 21*b* do not come into contact with the surface 21.

Where appropriate, for example, as shown in FIG. 9A, the treatment member 20 may comprise at least two separate portions 20*a* and 20*b* that define respective hot surfaces 21*a* and 21*b* with which the bristles 11 of the brush 5 can come into contact.

Depending on the duration of contact with the heated surface 21, and in particular depending on the speed of rotation of the brush 5, the contact pressure of the bristles 11 against the surface 21, the friction forces between the bristles 11 and the surface 21, and also the nature of the bristles 11 of the brush 5, it is possible for the initial rectilinear shape of the bristles 11 to be modified to a greater or lesser extent, for example, for the purpose of obtaining shapes that are curved to a greater or lesser extent, as shown in FIGS. 10 to 12.

In the exemplary embodiments of FIGS. 4, 6, 8, 9, and 9A, the brush 5 may be rotated about the axis Y and the treatment member 20 need not be rotated or rotatable.

In various exemplary embodiments, the treatment member 20 may be rotated while the brush 5 is kept stationary, thereby making it possible to treat only a fraction of the circumference of the brush 5. For example, the treatment member may be rotated to treat only a first set s' of bristles so as to be curved over a portion of the circumferential surface, with a second set s" of bristles of the brush 5 that are left rectilinear over the remainder of the surface, as shown in FIG. 13.

The invention also contemplates other embodiments, for example, in which the bristles 11 are treated in a certain manner over a sector s' of the circumference of the brush 5 and in another manner over a different sector s". For example, the bristles 11 over the sector s' may be treated in such a manner as to orient the bristles 11 *m* clockwise, and the bristles 11 over the sector s" may be treated in such a manner as to orient the bristles 11 in the opposite direction.

In exemplary embodiments in which the brush has an envelope with a cross-section that is not circular in shape, for example, the different sides of the brush 5 may be treated differently. For example, for the brush shown in FIG. 13B, the sides of the brush 5 may be treated in such a manner as to orient all of the bristles 11 on one side in a given direction, with the direction in which the bristles 11 are oriented being reversed on advancing to the next side.

In exemplary embodiments, the brush 5 may comprise a mixture of long bristles 11*a* and short bristles 11*b* and may be treated in such a manner that only the long bristles 11*a* come into contact with the heated surface 21 and take on a curved shape, the short bristles 11*b* not being heated and remaining rectilinear, for example, as shown in FIG. 14.

As discussed above, in exemplary embodiments, the brush 5 may have an envelope surface, as defined by the free ends of the bristles 11, that is non-circular in section.

Figure 15:
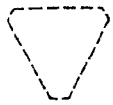
FIG. 15 is a diagrammatic cross-section view showing an exemplary brush envelope that is substantially triangular in cross-section.
Figure 16:
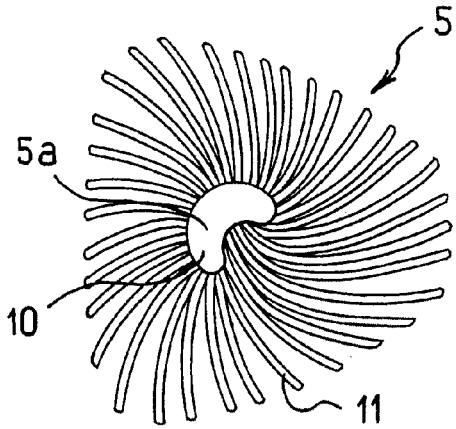
FIG. 16 is a diagrammatic cross-section view of the distal end of an exemplary brush with an envelope having a cross-section substantially corresponding to the envelope of FIG. 15.

For example, FIG. 15 shows an exemplary envelope surface of cross-section that is substantially prismatic, for example, substantially triangular. With such a brush 5, by causing the brush 5 to turn about the axis Y in contact with a heated surface, the bristles 11 may be given a curved shape, for example, in a counterclockwise direction, as shown in FIG. 16.

Figure 17:
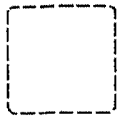
FIG. 17 is a diagrammatic cross-section view showing an exemplary brush envelope that is generally square in cross-section.

FIG. 17 shows an exemplary envelope surface of cross-section that is substantially square.

Figure 18:
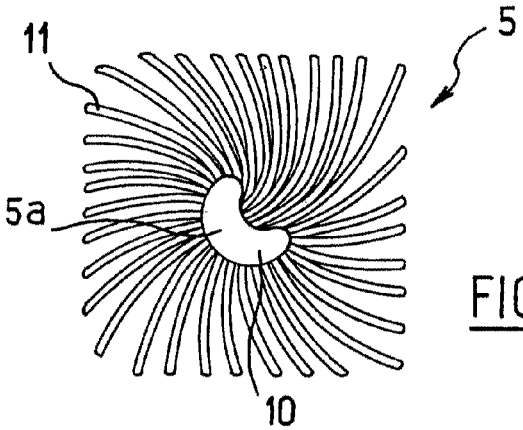
FIG. 18 is a diagrammatic cross-section view of the distal end of an exemplary brush with an envelope having a cross-section substantially corresponding to the envelope of FIG. 17.

With such a brush 5, for example, a curved shape for the bristles 11 may be obtained as shown in FIG. 18, with the bristles being oriented, for example, in a counter-clockwise direction.

FIGS. 19 to 26 show further exemplary shapes, although non-exhaustive, for the cross-section of the envelope surface of the brush 5.

Figure 19:
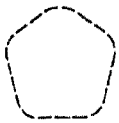
FIGS. 19 to 26 are diagrammatic cross-section views of other exemplary embodiments of brush envelopes according to the invention.
Figure 20:
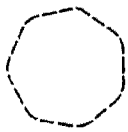

FIG. 19 shows an exemplary shape that is substantially pentagonal and FIG. 20 shows an exemplary shape that is substantially hexagonal.

Figure 21:
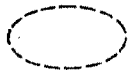

FIG. 21 shows an exemplary shape that is substantially oval.

Figure 22:
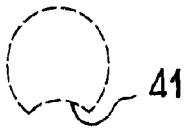

FIG. 22 shows an exemplary embodiment in which the brush 5 has at least one indentation 41, which may be concave toward the outside as shown. Such an indentation 41 may have a cross-section that is constant or otherwise along the length of the brush 5.

Figure 23:
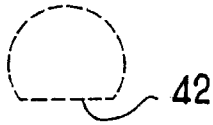

FIG. 23 shows an exemplary embodiment in which at least one facet 42 that is substantially planar is formed on the brush 5.

Figure 24:
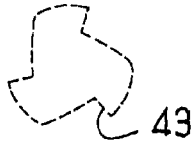

FIG. 24 shows an exemplary embodiment in which the brush 5 has at least one notch 43, for example, three notches as shown.

Figure 25:
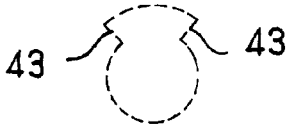
Figure 26:
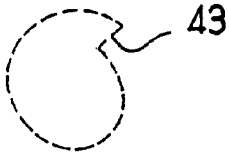

FIG. 25 shows an exemplary embodiment of a brush 5 having two notches 43 and FIG. 26 shows an exemplary embodiment of a brush 5 having only one notch 43.

In exemplary embodiments, the core 10 may be centered relative to the perimeter of the envelope surface as the brush 5 is observed in cross-section.

Figure 27:
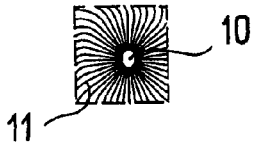
FIG. 27 is a diagrammatic cross-section view showing an exemplary embodiment with a core that is off-center.

In other embodiments, for example, as shown in FIG. 27, a brush 5 may include a core that is off-center.

In exemplary embodiments, the cross-section of the brush 5 may be constant or otherwise. Further, in exemplary embodiments, the core may be rectilinear or otherwise.

Figure 28:
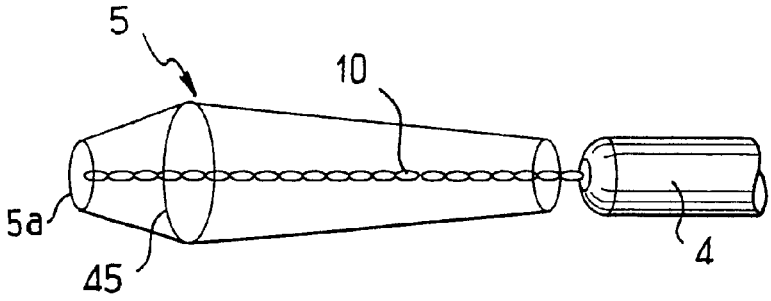
FIGS. 28 and 29 are diagrammatic partial plan views showing exemplary brush envelopes with a cross-section that is not constant.

In embodiments in which the core is rectilinear, either because the final brush 5 has a rectilinear core or because the core has been straightened out to be rectilinear for observation purposes, the brush 5 may have a cross-section that passes through an extremum 45, as shown in FIG. 28. Such an extremum may be a maximum or a minimum.

Figure 29:
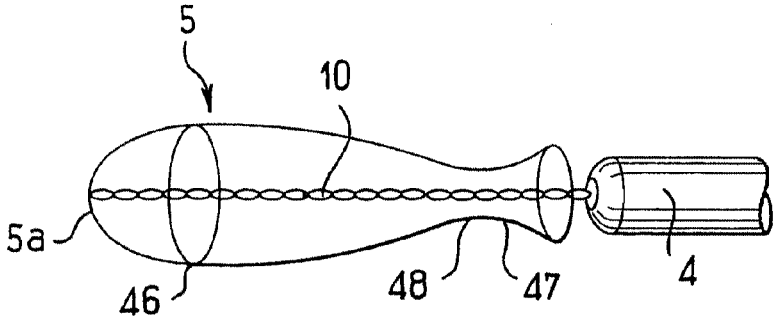

As shown in the exemplary embodiment of FIG. 29, the cross-section of the brush 5 may pass through both a maximum 46 and a minimum 47.

Figure 30:
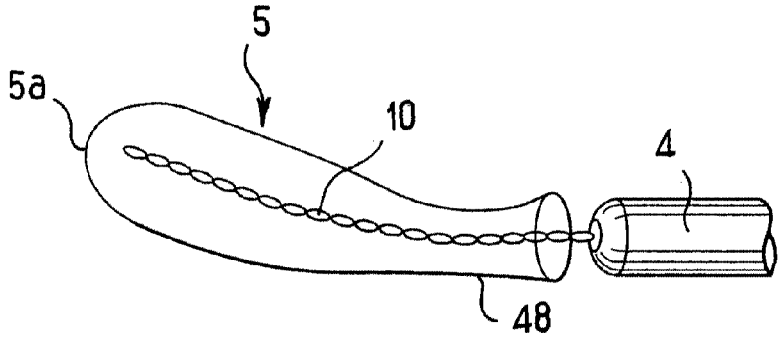
FIG. 30 is a diagrammatic partial plan view of the brush of FIG. 29 with a core that has been curved.

In exemplary embodiments, the core 10 may be curved, for example, so as to straighten out one edge 48 of the brush 5, as shown in FIGS. 28 and 30.

Figure 31:
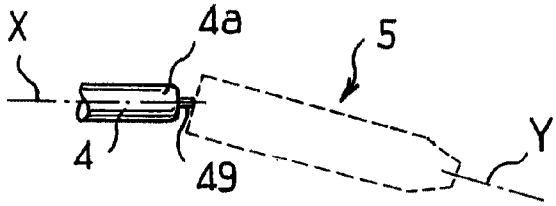
FIG. 31 is a diagrammatic partial plan view of another exemplary embodiment of a curved-core brush.

In exemplary embodiments, the brush 5 may also have a core 10 that includes a bend 49 close to the distal end 4*a* of the brush 4, as shown in FIG. 31, with the portion of the core 10 that carries the bristles 11 being rectilinear, for example.

Figure 32:
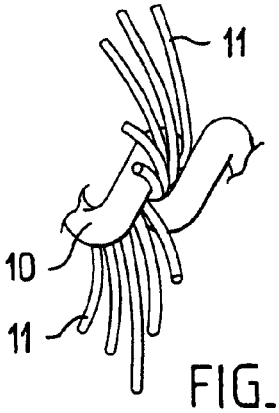
FIG. 32 is a diagrammatic and fragmentary view showing bristles held between twisted branches of the core, analogous to FIG. 3, with a portion of a brush core twisted to the right.

In all of the above exemplary embodiments, the brush 5 may be twisted to the right, as shown in FIG. 32.

In exemplary embodiments, the brush 5 may comprise a mixture of bristles 11 of different lengths measured from the core 10, or even different kinds, for example, different shapes and/or materials.

Figure 33:
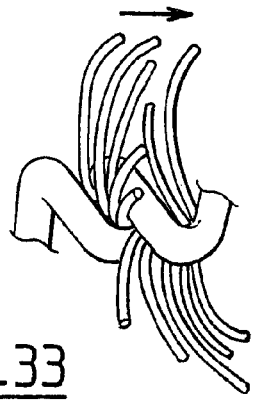
FIG. 33 is a diagrammatic and fragmentary view showing bristles held between twisted branches of the core, analogous to FIG. 3, with a portion of a brush in which the bristles are curved both circumferentially and axially.

FIG. 33 shows an exemplary embodiment in which the bristles 11 are oriented both in the circumferential direction and in the axial direction, i.e., the direction of the arrow in FIG. 33.

In exemplary embodiments, the bristles 11 may have a variety of cross-sections, for example, other than circular.

Figure 34:
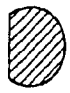
FIGS. 34 to 51 are diagrammatic views showing various exemplary embodiments of cross-sections of the bristles according to the invention.
Figure 35:
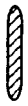
Figure 36:
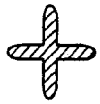
Figure 37:
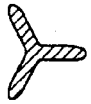
Figure 38:
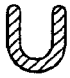
Figure 39:
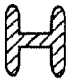
Figure 40:
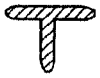
Figure 41:
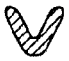
Figure 42:
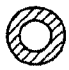
Figure 43:
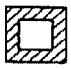
Figure 44:
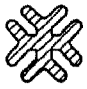
Figure 45:
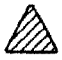
Figure 46:
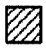
Figure 47:
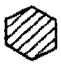
Figure 48:
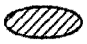
Figure 49:
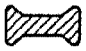

For example, exemplary embodiments may use bristles 11 with a cross-section having any of the shapes shown diagrammatically in FIGS. 34 to 51. The bristles 11 may have, for example, a circular shape with a flat portion as shown in FIG. 34, a flat shape as shown in FIG. 35, a star shape, such as a cross as shown in FIG. 36, or such as one having three branches as shown in FIG. 37, a U-shape as shown in FIG. 38, an H-shape as shown in FIG. 39, a T-shape as shown in FIG. 40, a V-shape as shown in FIG. 41, a hollow shape, such as a circular hollow shape as shown in FIG. 42, or such as a prismatic, for example, a square hollow shape as shown in FIG. 43, a shape forming ramifications, such as a snowflake as shown in FIG. 44, a section that is polygonal, such as triangular as shown in FIG. 45, square as shown in FIG. 46, hexagonal as shown in FIG. 47, an oblong shape, such as a lens shape as shown in FIG. 48, or such as an hourglass shape as shown in FIG. 49.

Figure 50:
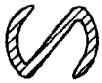
Figure 51:
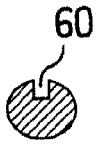
Figure 52:
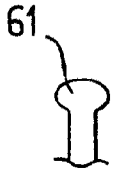
FIGS. 52 to 55 are diagrammatic partial axial views showing various exemplary embodiments of end portions of the bristles according to the invention.
Figure 53:
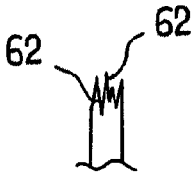

Exemplary embodiments are also contemplated that use bristles 11 including portions that are hinged to one another, for example, as shown in FIG. 50. Exemplary embodiments are also contemplated that use bristles 11 that have at least one capillary groove 60, for example, as shown in FIG. 51. Where appropriate, prior to being curved, the bristles 11 may be subjected to a treatment for forming beads 61 at their ends, for example, as shown in FIG. 52, or forks 62, for example, as shown in FIG. 53.

Figure 54:
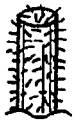
Figure 55:
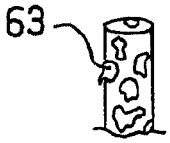

Exemplary embodiments are also contemplated that use flock-covered bristles 11, for example, as shown in FIG. 54, or bristles 11 made by extruding a plastics material that contains a filler of particles 63, for example, as shown in FIG. 54, in order to confer microrelief to the surface of the bristles, for example, or in order to impart magnetic or other properties thereto.

In exemplary embodiments, the bristles 11 may be made of a material having properties that facilitate sliding.

In exemplary embodiments, the bristles 11 may be made of synthetic materials selected, for example, from polyethylene, polyamides, such as PA6, PA6/6, PA6/10, PA6/12, or PA11, such as Rilsan®, a Hytrel®-Pebax® polymer, and other thermoplastic polymers.

Naturally, the invention is not limited to the examples described above.

Figure 56:
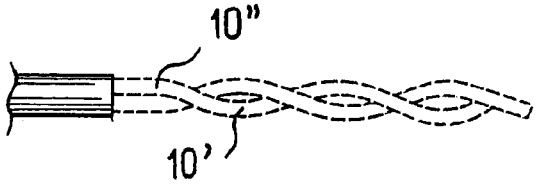
FIG. 56 is a diagrammatic partial plan view of a pair of cores, with the bristles being omitted.

Exemplary embodiments of the invention contemplate that the core 10 may be made differently, for example, by using a pair of individual cores 10' and 10" that are twisted around each other as shown in FIG. 56. Each of the individual cores 10', 10" in the exemplary embodiment shown may comprise two twisted-together strands that hold bristles.

In exemplary embodiments, the core 10 may be made using metal strands of optionally circular section. Such strands may optionally be sheathed.

It should be understood that the characteristics of the various embodiments described above may be combined with one another.

Throughout the description, including in the claims, the term "comprising a" should be understood as being synonymous with "comprising at least one", unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device comprising:

a receptacle containing a cosmetic substance and;

a brush for applying the substance onto keratinous fibers, the brush comprising:

a core;

bristles supported by the core, the bristles having a proximal end held by the core, the bristles and the core being separate elements and the core being a twisted core;

at least one portion along the axis of the core having all bristles that are curved so as to extend in an oriented and curved manner from the core and toward a free end of the bristles in a same circumferential direction about the core; and the curved bristles being twisted into the core so that their proximal ends form a helical pattern.

2. The device according to claim 1, wherein the core is twisted to the left.

3. The device according to claim 2, wherein the brush comprises an axis, a distal end and a proximal end, and wherein the bristles are oriented in a clockwise direction when the brush is observed along the axis from the distal end toward the proximal end.

4. The device according to claim 2, wherein the brush comprises an axis, a distal end and a proximal end, and wherein the bristles are oriented in a counter-clockwise direction when the brush is observed along the axis from the distal end toward the proximal end.

5. The device according to claim 1, wherein the curved bristles are generally oriented in a same axial direction.

6. The device according to claim 1, wherein at least 20% of the bristles are curved.

7. The device according to claim 1, wherein at least 50% of the bristles are curved.

8. The device according to claim 1, wherein at least 80% of the bristles are curved.

9. The device according to claim 1, wherein the core is a twisted wire core with turns and carries 5 to 60 bristles per turn.

10. The device according to claim 1, wherein the bristles are made of a thermoplastic material.

11. The device according to claim 1, wherein a diameter of the bristles lies in a range of about 5/100 mm to about 35/100 mm.

12. The device according to claim 1, wherein the bristles are of a length lying in a range of about 1 mm to about 7 mm.

13. The device according to claim 1, wherein the bristles are of a length lying in a range of about 2 mm to about 5 mm.

14. The device according to claim 1, wherein the brush includes at least one portion carrying a mixture of bristles of different lengths.

15. The device according to claim 14, wherein only longest of the bristles of the mixture have a shape that is curved, other bristles of the mixture extending from the core in a rectilinear manner.

16. The device according to claim 1, wherein the brush includes at least one portion carrying bristles of different kinds.

17. The device according to claim 1, wherein the bristles are curved along at least two distinct planes.

18. method of using a device according to claim 1, comprising:

supplying the cosmetic substance to at least the portion comprising curved bristles; and applying the cosmetic substance to keratinous fibers using at least the portion comprising curved bristles.

19. A method according to claim 18, wherein applying the substance comprises applying the substance onto at least one of eyelashes and eyebrows.

20. A device comprising:

a receptacle containing a cosmetic substance and;

a brush for applying the substance onto keratinous fibers, the brush comprising:

a core; and bristles supported by the core;

the brush including at least one portion having bristles that are curved so as to extend in an oriented and curved manner from the core and toward a free end of the bristles in a same circumferential direction about the core, and the brush including at least one portion carrying bristles made of materials having different vitreous transition temperatures, with only those bristles that are made of a material having the lowest vitreous transition temperature being curved.

21. A device comprising:

a receptacle containing a cosmetic substance; and a brush for applying the substance onto keratinous fibers, the brush comprising:

a core; and bristles supported by the core, the bristles and the core being separate elements and the core being a twisted core with turns and carrying 5 to 60 bristles per turn;

the brush including at least one portion along the axis of the core having all bristles that are curved so as to extend in an oriented and curved manner from the core and toward a free end of the bristles in a same circumferential direction about the core.

22. A device comprising:

a receptacle containing a cosmetic substance; and a brush for applying the substance onto keratinous fibers, the brush comprising:

a core; and bristles supported by the core, the bristles and the core being separate elements and the core being a twisted core;

the brush including:

at least one portion along the axis of the core having all bristles that are curved so as to extend in an oriented and curved manner from the core and toward a free end of the bristles in a same circumferential direction about the core; and at least one portion carrying a mixture of bristles of different lengths, wherein only longest of the bristles of the mixture have a shape that is curved, other bristles of the mixture extending from the core in a rectilinear manner.

* * * * *